US012115434B1

(12) United States Patent
Riordan

(10) Patent No.: US 12,115,434 B1
(45) Date of Patent: Oct. 15, 2024

(54) PORTABLE METHOD FOR MANAGING INTERVAL TIME FOR GOLFERS

(71) Applicant: William John Riordan, Carlsbad, CA (US)

(72) Inventor: William John Riordan, Carlsbad, CA (US)

( * ) Notice: Subject to any disclaimer, the term of this patent is extended or adjusted under 35 U.S.C. 154(b) by 0 days.

(21) Appl. No.: 18/327,543

(22) Filed: Jun. 1, 2023

(51) Int. Cl.
*A63B 71/06* (2006.01)

(52) U.S. Cl.
CPC ..... *A63B 71/0686* (2013.01); *A63B 71/0605* (2013.01); *A63B 71/0622* (2013.01); *A63B 2225/20* (2013.01)

(58) Field of Classification Search
CPC ..... A63B 71/0686; A63B 71/0605; A63B 71/0622; A63B 2225/20
See application file for complete search history.

(56) References Cited

U.S. PATENT DOCUMENTS

| | | | | |
|---|---|---|---|---|
| 9,868,045 | B2 * | 1/2018 | Stephens | A63B 57/357 |
| 2005/0192124 | A1 * | 9/2005 | Tetens | A63B 71/0605 473/405 |
| 2014/0379105 | A1 * | 12/2014 | Glasson | G07F 17/38 700/91 |
| 2018/0008880 | A1 * | 1/2018 | Robinson | A63B 71/0616 |

* cited by examiner

*Primary Examiner* — Jeffrey S Vanderveen

(57) ABSTRACT

A simple low-cost portable method for golfers to be active in the management of interval time. In particular, the method has golfer groups with a scannable code and uses simple off-the-shelf electronics on the golf course to capture data used to determine interval time. The interval time is available to determine same day consequences for long interval time as well as interval time of a golfer whereby interval time of the golfer influences access to tee times and position on the tee sheet for tournaments. Additionally, golf course management uses of interval time of golfers whereby available tee times are increased and golfer experience is improved.

6 Claims, 6 Drawing Sheets

PORTABLE METHOD FOR MANAGING INTERVAL TIME FOR GOLFERS

CROSS REFERENCE TO RELATED APPLICATIONS

None

STATEMENT OF FEDERALLY SPONSORED RESEARCH nonapplicable

SEQUENCE LISTING OR PROGRAM nonapplicable

FIELD OF THE INVENTION

Playing golf. Specifically, golfer involved recording the time at locations on a golf course and using the recorded time to determine and use interval time for tournament and golf course management.

BACKGROUND OF THE INVENTION

The pace of play (POP) at many golf courses results in some rounds of golf taking more than six hours. Slow POP reduces demand for playing golf. Golfers have limited control on PoP because of all the variables impacting POP. The variables include golf course design, placement of golf holes on the putting greens, weather conditions, tournament design, golfer experience and golf skill level. Many methods have been invented to monitor pace of play.

PRIOR ART

Prior inventions for the management of golf courses and managing the pace of play of golfers rely on one or more of the following:

a) use of a global positioning system capability,
b) an electrical device with the golfer group,
c) does not require the golfer group to record any information,
d) an expensive implementation,
e) based on use in a single golf course monitoring the pace of play,
f) monitors pace of play,
g) scope is to one round of golf,
h) uses custom hardware,
i) an archaic method of removing the flag from the hole.

Inventions using a global positioning system capability for location increases a variability of precision of time at a location.

Inventions using an electrical device with the golfer group adds to cost and complexity of dispersing and collecting the electrical device. Devices mounted to a golf cart do not account for walking golfers.

Inventions not requiring the golfer group to record any information reduce the effect of reminding of the importance of staying in position.

Inventions with an expensive implementation limit the economic value and have a high overall lifecycle cost.

Inventions based on use in a single golf course monitoring the pace of play as specific hardware, networks, and other infrastructure are needed to utilize the invention whereby reducing adoption and continued use of the invention.

Pace of play is an outcome of many variables. Golfers have limited influence on pace of play.

Monitoring of pace of play is passive and has minimal improvement on the golfer experience.

Inventions with scope based on one round of golf limits using the data to influence future rounds of golf.

Inventions using custom hardware have a lifecycle risk of replacement units not being available over time rendering the invention inoperable at the golf course.

Inventions relying on the method of removing the flag from the hole are not reliable as golf rules no longer require the flag to be removed from the hole.

U.S. Pat. No. 5,357,487 discloses an electrical device with the golfer group, does not require the golfer group to record any information, monitoring the pace of play, scope is to one round of golf, and includes annoying alarms while playing golf.

U.S. Pat. No. 5,524,081 discloses an electrical device with the golfer group, does not require the golfer group to record any information, monitoring the pace of play, scope is to one round of golf, and includes annoying alarms while playing golf.

U.S. Pat. No. 6,033,316 discloses an electrical device with the golfer group, does not require the golfer group to record any information, monitoring the pace of play, scope is to one round of golf, and bases pace of play progress against a standard pace of play.

U.S. Pat. No. 6,135,893 discloses does not require the golfer group to record any information, monitoring the pace of play, scope is to one round of golf, and uses a graphical method to identify slow play.

U.S. Pat. No. 6,236,360 discloses use of a global positioning system capability, an electrical device with the golfer group, does not require the golfer group to record information, an expensive implementation, monitoring the pace of play, scope is to one round of golf, and is a visual and yardage display system.

US Pat. No. 20010006489 discloses monitoring the pace of play, and provides rewards for pace of play for the total round of golf.

Rewarding for pace of play does not account for the people that are slow. When one group is behind pace, the remaining golfer groups will be late and not rewarded.

U.S. Pat. No. 6,346,055 discloses monitoring the pace of play, and relying on the flag to be moved is no longer viable as the new rules of golf do not require the flag to be removed from the hole.

US Pat. No. 20040064206 discloses does not require the golfer group to record any information, monitoring the pace of play, and relying on the flag to be moved is no longer viable as the new rules of golf do not require the flag to be removed from the hole.

US Pat. No. 20040073325 discloses an electrical device with the golfer group, does not require the golfer group to record any information, monitoring the pace of play, and stores stroke specific data.

US Pat. No. 20040243262 discloses an electrical device with the golfer group, does not require the golfer group to record any information, the design is based on use in a single golf course monitoring the pace of play.

US Pat. No. 20090069120 discloses does not require the golfer group to record any information, monitoring the pace of play.

US Pat. No. 20090201263 discloses use of a global positioning system capability, an electrical device with the golfer group, does not require the golfer group to record any information, monitoring the pace of play, includes a touch screen, and provides yardage measurement.

US Pat. No. 20150231460 discloses does not require the golfer group to record any information, the design is based on use in a single golf course and relying on the flag to be moved is no longer viable as the new rules of golf do not require the flag to be removed from the hole.

US Pat. No. 20170039661 discloses use of a global positioning system capability, an electrical device with the golfer group, does not require the golfer group to record any information, an expensive implementation, the design is based on use in a single golf course monitoring the pace of play.

US Pat. No. 20170216703 discloses use of a global positioning system capability, an electrical device with the golfer group, does not require the golfer group to record any information, the design is based on use in a single golf course monitoring the pace of play, and invention determines the slow playing golfer group.

US Pat. No. 20180204227 discloses use of a global positioning system capability, an electrical device with the golfer group, does not require the golfer group to record any information, the design is based on use in a single golf course monitoring the pace of play, and invention value is visibility of actual pace of play.

US Pat. No. 20200078659 discloses an electrical device with the golfer group, the design is based on use in a single golf course, scope is to one round of golf, and uses custom hardware.

SUMMARY OF THE INVENTION

Golfer groups have a significant control on staying in position behind the golfer group ahead. A metric to measure said position is the amount of time between golfer groups at a location on the golf course is called interval time. The USGA has recommended numerous actions golfers can take to stay in position. When golfers take action to track interval time during play, a golfer is reminded to minimize interval time. Golfer groups record scores on a paper scorecard and a scannable code can be on the scorecard. An alternate embodiment, a golfer group scores with another device, said scannable code can be on the device using an adhesive backed piece of paper or embedded in the device. This invention is reliable, verifiable, and low cost to gather, store, analyze, and reuse interval time. The interval time is stored and reused whereby improving the golf experience and increasing utilization of the golf course increasing revenue.

DESCRIPTION

Brief Description of the Figures

These and other characteristics of the present invention will be more fully understood by reference to the following detailed description in conjunction with the attached figures, in which.

DETAILED DESCRIPTION

Definitions

Figure 1:
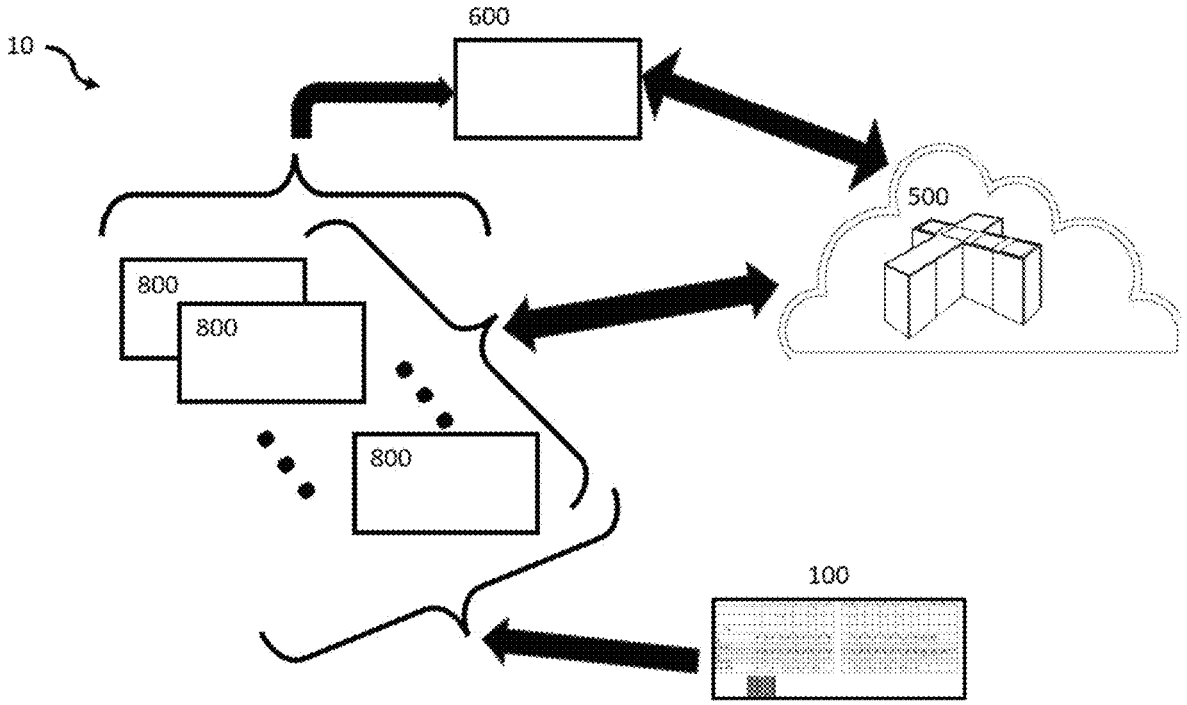
FIG. 1 is an illustrative method for implementing the steps in accordance with the aspects of the invention.

External systems 600: Typical services utilized as an element of the embodiment of the invention. These would include an internet service, telecommunications service, video analysis service, golf course management service, tournament management service, membership management service. These services provide inputs to or utilize outputs from the method for managing interval time. Information exchange methods includes file upload, file download, application interfaces (APIs), and manual transfer whereby enabling widespread use of interval times in golf course operations minimizing a need to replace existing systems.

Golfer group: A plurality of golfers associated to a tee time. Commonly, one to four golfers and may include caddies, volunteers, observers, rules officials assigned to the golfer group.

Interval time: An amount of time determined through analysis of times recorded by golfer groups at locations on a golfcourse.

Interval time of a golfer: An amount of time determined through analysis of the plurality of interval times of rounds of golf saved for said golfer.

Interval time (IT) of golfer group: Actual amount of time between golfer groups during a round of golf a location on a golf course. Visually seen as position of golfer group in relation to the golfer group ahead.

Interval time threshold (ITT): The interval time standard indicating a golfer group position status as "in position" or "out of position." Interval time less than the interval time threshold is "in position." Interval time equal to or greater than the interval time threshold is "out of position."

Standard Pace of play (SPOP): A predefined cumulative amount of time to complete a plurality of golf holes.

Pace of play (POP): A cumulative amount of time to complete a plurality of golf holes.

Interval time of a round of golf: An amount of time determined through analysis of the plurality of interval times captured for a golfer group during a specific round of golf and assigned to each golfer in the golfer group.

Pace of play threshold (POPT): The pace of play compared to the standard pace of play. The actual the pace of play compared to the standard pace of play less than the Pace of play threshold time are "on time." The actual the pace of play compared to the standard pace of play equal to or greater than the pace of play threshold are "slow."

Round of golf: Playing a plurality of golf holes. For example, 9 holes or 18 holes are typical number of holes to complete a round of golf Tee Time: The time set for a plurality of golfers to start playing golf. Tee time includes the number of golfers for the tee time.

FIG. 1-13, wherein like parts are designated by like reference numerals throughout, illustrate an example embodiment of the method for managing interval time 10, according to the present invention. The present invention will be described with reference to the example embodiment illustrated in the figures. Many alternative forms can embody the present invention. There are different ways to alter the parameters of the embodiments disclosed in a manner still in keeping with the spirit and scope of the present invention. This illustrative embodiment of the present invention relates to the method of actively involving golfer groups in recording information for said interval time (IT) of said golfer groups at a golf course and providing the golfer groups with immediate feedback whereby reminding said golfers to improve their interval times for an improved overall throughput of golfers at a golf course. The placement of a plurality of portable recording stations 800 within a golf course for recording data with active involvement of said golfer groups. The collected data is used to determine interval time metrics used by said golfers and operators of the golf course whereby enhancing the golfer experience through a reduction in wait times and the total amount of time to complete a round of golf. The method for managing interval time 10 provides data access and analysis whereby enabling the golf course management to improve the golfer experience, increase the number of golfers utilizing the golf course, and increase revenue.

FIG. 1. Illustrates an embodiment of the method for managing interval time 10. A plurality of portable recording stations 800 are distributed within the golf course preferably next to the teeing areas of one to eighteen golf holes. Said golfer groups will carry one to four scannable golfer identifiers (SGIs) 100. The SGI can be for the golfer group or for each golfer. The golfer groups scan their SGI upon arrival at each of the portable recording stations 800. The scanned SGI and time data at each portable recording station 800 is saved and transferred to the remote computing device 500. The video data from each portable recording station 800 is transferred to the external system 600. The video data is stored and analyzed by the external system 600 and made available to the remote computing device 500. The provided data is used to enable the method for managing interval time 10. The remote computing device 500 provides data to external systems 600 whereby enabling the golf course management to improve the golfer experience and increase the number of golfers utilizing the golf course.

FIGS. 2-7 illustrates the portable recording station 800 including the components to have the golfer group actively participate in recording information for interval time. The portable recording station 800 includes a notification sign 200, a scanning device 300, a local computing device 400, and a camera 700.

Figure 4:
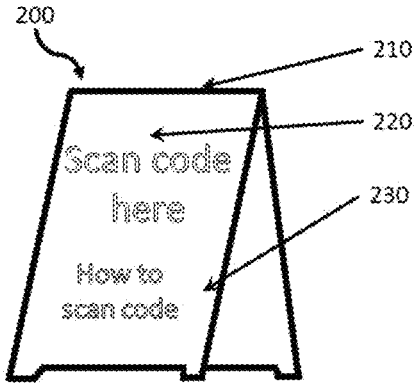
FIG. 4 is illustrative of the notification sign, in accordance with the aspects of the invention.

FIG. 4 depicts an illustrative example of a notification sign 200 included in the portable recording station 800. The notification sign 200 is on a self-supporting frame 210 whereby the sign 200 is portable. Information included in the sign 200 is a reminder to record data 220 and instructions explaining how to record data 230 whereby the golfer group knows it is time to record data using the SGI and how to record data using the SGI.

Figure 3:
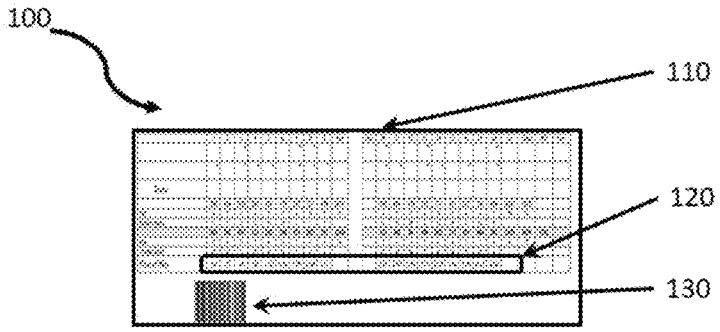
FIG. 3 is illustrative of the scannable golfer identifier (SGI) in accordance with the aspects of the invention.

FIG. 3 depicts an illustrative example of the scannable golfer identifier (SGI) 100 provided to each golfer group for active use throughout the golf course. The SGI 100 includes a score recording item 110, a hole-by-hole completion time 120, and a scannable golfer identifier (SGI) code 130. In this embodiment, the golfer can record his score, evaluate the overall pace by reviewing expected hole completion time 120 with the current time, and record using the SGI code 130 at approximately the same time in the teeing area whereby the golfer group will be actively involved in understanding the interval time at approximately the same time of using the score recording item. One or more golfers in the golfer group record using the SGI code 130 using the scanning device 300. The scanned code 130 and time and date of recording is the data saved and transferred to the local computing device 400 for analysis. In accordance with one example embodiment, said data is saved and transferred from the local computing device 400 to the remote computing device 500 for analysis. Both the local computing device 400 and the remote computing device 500 includes a data management capability to analyze said data with a focus on analyzing interval times and PoPs within the plurality of portable recording stations 800 and at the remote computing device 500.

In accordance with an example embodiment, the scannable golfer identifier (SGI) 100 can be secondary computing devices used to supplement the other components of the interval time management method 10. For example, the scannable golfer identifier (SGI) 100 can be a mobile computing device (e.g., smartphone, tablet, laptop, smart watch, etc.) whereby the scannable golfer identifier (SGI) can communicate with remote computing device 500 and/or the local computing device 400 over a telecommunication network to access information provided by the interval time management method 10 through the use mobile/software applications, accessing through a webpage, or a combination thereof.

Figure 5:
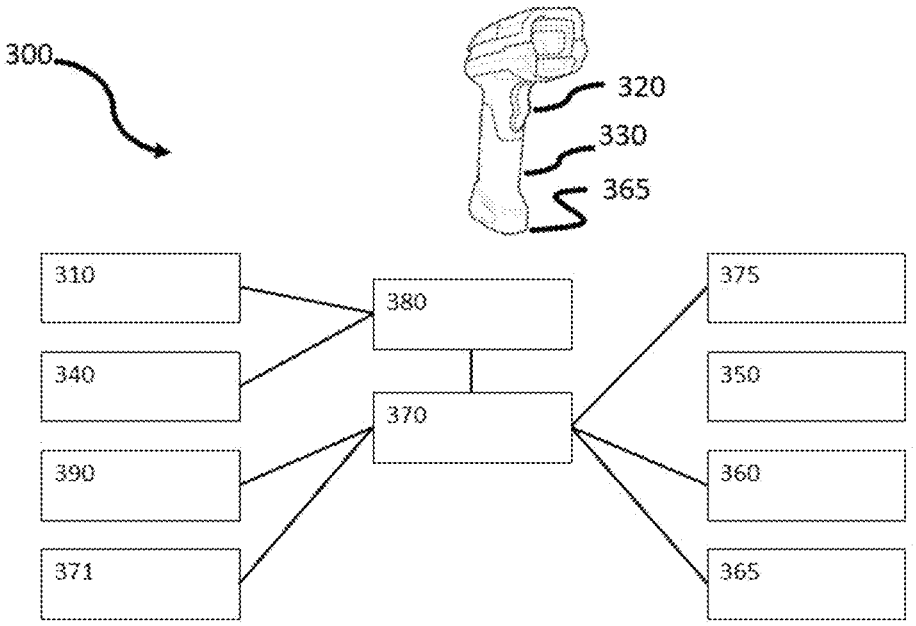
FIG. 5 is illustrative of the recording device, in accordance with the aspects of the invention.

FIG. 5 depicts an illustrative example of a scanning device 300. An outgoing light beam from the light source 310 is generated in the scanning device 300 and directed to impinge on a scannable code 130 a few inches from the front of the scanning device. The outgoing beam 310 is scanned in a pattern, and the user positions the hand-held scanning device until this scan pattern traverses the scannable code to be read. Reflected light from the scannable code is detected by a light-responsive detector 340 in the scanning device, producing serial electrical signals to be processed 380 for identifying the scannable code. The processed scannable code and the clock 375 time of scanning are stored in memory 371 and sent to the local computing device 400 via wireless transceiver 360 or via wired input/output module 365. The scanning device 300 is a gun-shaped device having a pistol-grip type of handle 330, and a movable trigger 320 is employed to allow the user to activate the outgoing light beam 310 and detector circuitry when pointed at the scannable code to be read, whereby saving battery life if the unit is self-powered. Messages sent to the scanning device from the local computing device 400 are received by wireless transceiver 360 or wired input/output module 365 and processed by the central processing unit (CPU) 370 and sent to the small display 390. The scanning device also contains a battery 350 whereby enabling portability and placement at remote areas of the golf course.

In accordance with an example embodiment of the present invention, the remote computing device 500 can be a cloud computing and storage environment configured to collect, aggregate, analyze, and provide metrics using said recorded data received from the local computing devices 400 and video analysis, tee times, golfer identifier, and golfer penalty decisions from external systems 600. The remote computing device 500 can also include a database management system utilizing a given database model configured to interact with a user for analyzing the database data. Additionally, the remote computing device 500 can analyze said recorded data, time data, and other information to distribute instructions and/or feedback information utilizing the telecommunications interface to notify golf course and/or golf event management.

Figure 6:
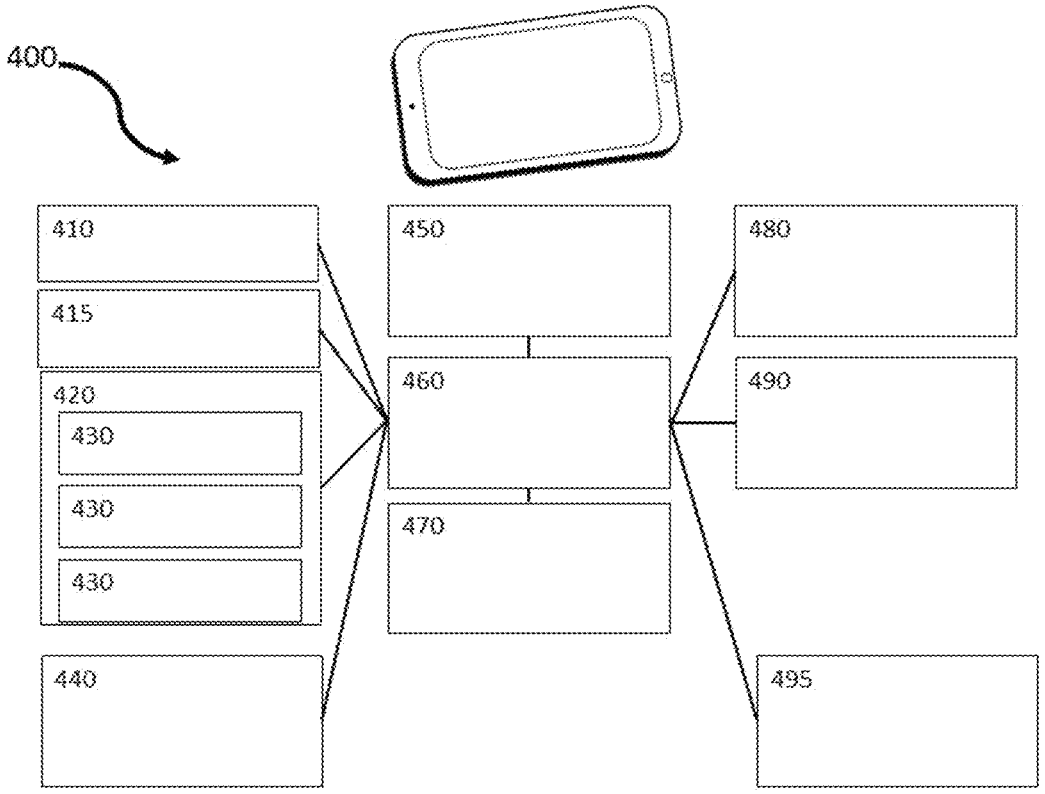
FIG. 6 is illustrative of the local computing device, in accordance with the aspects of the invention.
Figure 7:
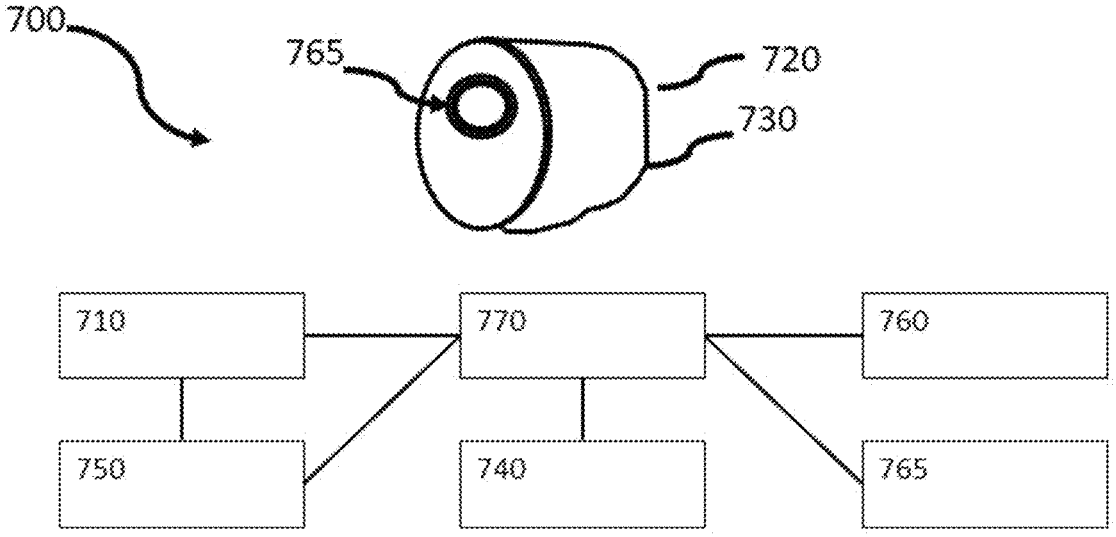
FIG. 7 is illustrative of the camera, in accordance with the aspects of the invention.
Figure 8:
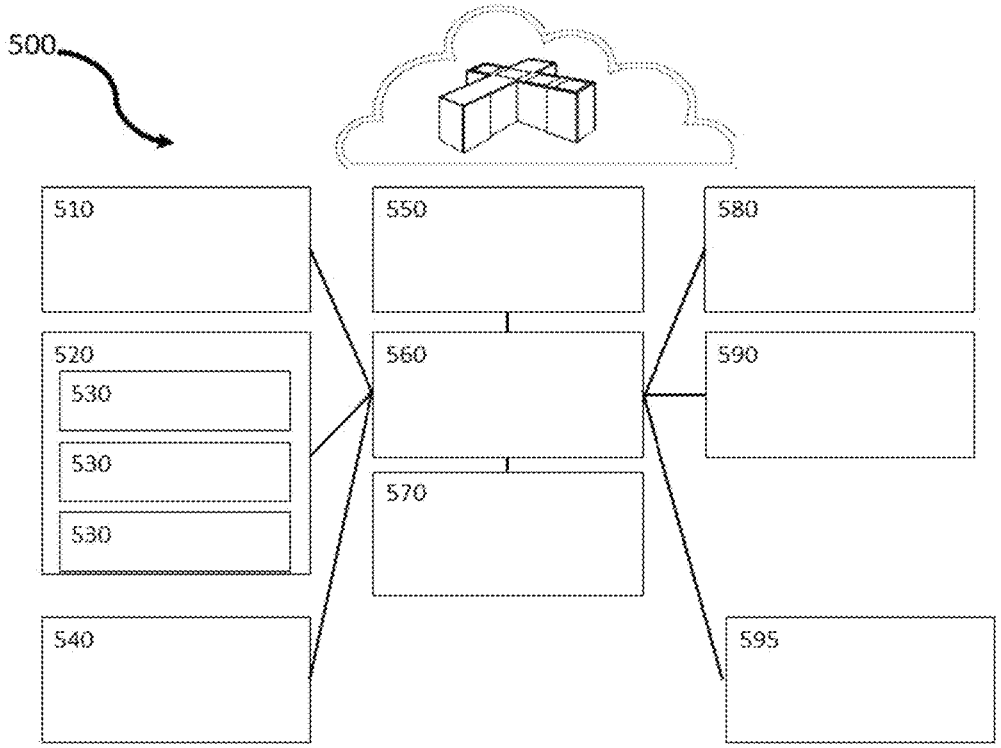
FIG. 8 is illustrative of the remote computing device, in accordance with the aspects of the invention.

Any suitable hardware device can be used to implement the various video, scanning and computing devices 100, 300, 400, 500, 700 and methods/functionality described herein and be converted to a specific system for performing the operations and features described herein through modification of hardware, software, and firmware, in a manner significantly more than mere execution of software on a generic computing device. One illustrative example of such a computing device 400 is depicted in FIG. 6. The computing device 400 is merely an illustrative example of a suitable computing environment and in no way limits the scope of the present invention. A "computing device," as represented by FIG. 6, can include a "workstation," a "server," a "laptop," a "desktop," a "hand-held device," a "mobile device," a "tablet computer," or other computing devices. Given that the computing device 400 is depicted for illustrative purposes, embodiments of the present invention may utilize any number of computing devices 400 in any number of different ways to implement a single embodiment of the present invention. Accordingly, embodiments of the present invention are not limited to a single computing device 400 nor are they limited to a single type of implementation or configuration of the example computing device 400.

The computing device 400 can include a bus 460 that can be coupled to one or more of the following illustrative components, directly or indirectly: a memory 420, one or more processors 490, one or more presentation components 495, input/output ports 410 and 415, and a power supply 470. The bus 460 can include one or more busses, such as an address bus, a data bus, or any combination thereof. Depending on the intended applications and uses of a particular embodiment, multiple of these components can be implemented by a single device. Similarly, in some instances, a single component can be implemented by multiple devices. As such, FIG. 6 is merely illustrative of an exemplary computing device that can be used to implement one or more embodiments of the present invention, and in no way limits the invention.

The memory 420 can include computer-storage media in the form of volatile and/or nonvolatile memory. The memory 420 may be removable, non-removable, or any combination thereof. Exemplary hardware devices are devices such as hard drives, solid-state memory, optical-disc drives, and the like. The computing device 400 can include one or more processors that read data from components such as the memory 420, the various I/O components including local wireless module 410, local wired input/output module 415, wide area network/telecommunications module 450, etc. Presentation component(s) 495 present data indications to a user or other device. Exemplary presentation components include a display device, speaker, printing component, vibrating component, etc.

Figure 9:
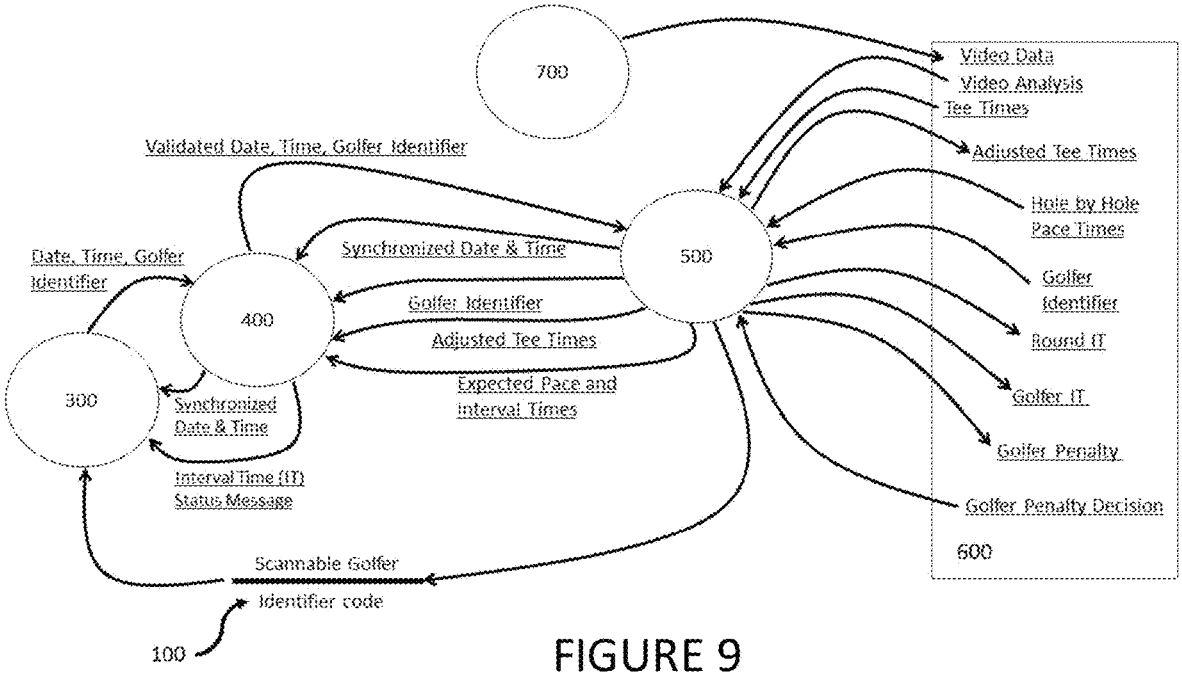
FIG. 9 is an illustrative flowchart depicting information flow, in accordance with aspects of the invention.

Referring to FIG. 9, an illustrative embodiment of an information flow diagram of certain data exchange performed by the illustrative embodiments. The actual optimum organization and structure of software to control various hardware components in accordance with the invention will depend greatly on the characteristics of the specific hardware with which the invention is implemented, and likewise that functions shown as implemented in software can equivalently be implemented in, e.g., smart phone hardware and vice versa. By and large, the information flow chart does not set forth common error trapping/handling, boundary condition detection, and similar conventional functions.

Figure 10:
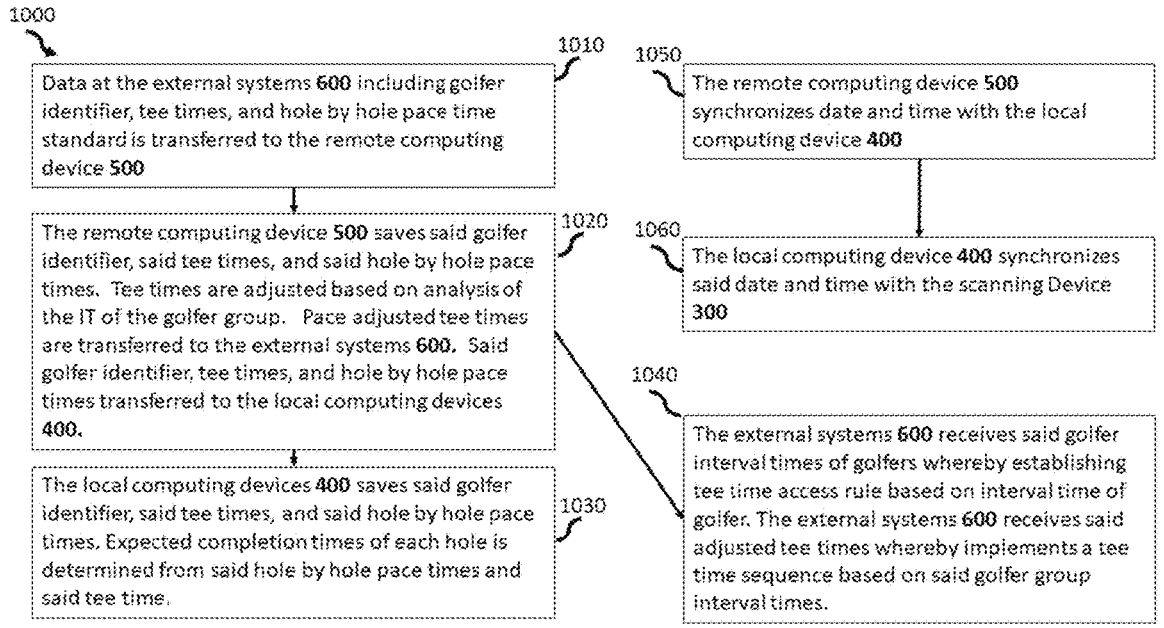
FIG. 10 is an illustrative flowchart depicting operation of the method for managing interval time related prior to recording information for a round of golf, in accordance with aspects of the invention.

Referring to FIG. 10, at step 1010, an embodiment of the present invention illustrates the remote computing device 500 obtaining tee times including golfers assigned to each tee time, hole by hole standard pace times, and a golfer identifier from external systems 600.

At step 1020, the remote computing device 500 to assigns said golfers together based on the interval times of said golfers. In particular, the remote computing device 500 can assign golfer groups that share similar interval times of golfer. The remote computing device 500 with interval times of golfer determines the optimal tee times for the golfers whereby the interval between tee times of golfer groups is lower for the golfers with lower interval times of golfer compared to golfer groups with higher interval times of golfer. Interval time of golfer adjusted tee times are transferred to the external systems 600. Golfer identifier, tee times, and standard pace times for each hole transferred to the local computing devices 400.

Referring to FIG. 9 and FIG. 10 at step 1030, the local computing devices 400 saves golfer identifier, tee times, and standard pace times for each hole whereby enabling the portable recording station to analyze and provide messages to golfer groups if real time communication with the remote computing device 500 is not available. Expected completion times of each hole is determined from standard pace times for each hole and tee time.

Referring to FIG. 9 and FIG. 10 at step 1040, interval times of golfers are received at the external systems 600 and used to aid in optimal tee times including access to times and time between tee times based on interval times of golfers. The remote computing device 500 can provide updated tee times including golfers assigned to each tee time. The external systems 600 updates the golfer groups assignments to tee times whereby optimizing interval times of golfers throughout the tee times by assigning the golfer groups with the lower interval times of golfers to earlier tee times.

Continuing reference to FIG. 9 and FIG. 10, at step 1050, the remote computing device 500 sends date and time to the local computing devices 400 to synchronize date and time. In addition, remote computing device 500 transfers golfer identifier, adjusted tee times, and standard pace times for each hole and interval times to the local computing devices 400. At step 1060, the local computing devices 400 transmits date and time to the scanning device 300 to synchronize date and time, whereby devices 500, 400 and 300 are synchronized for date and time.

Figure 11:
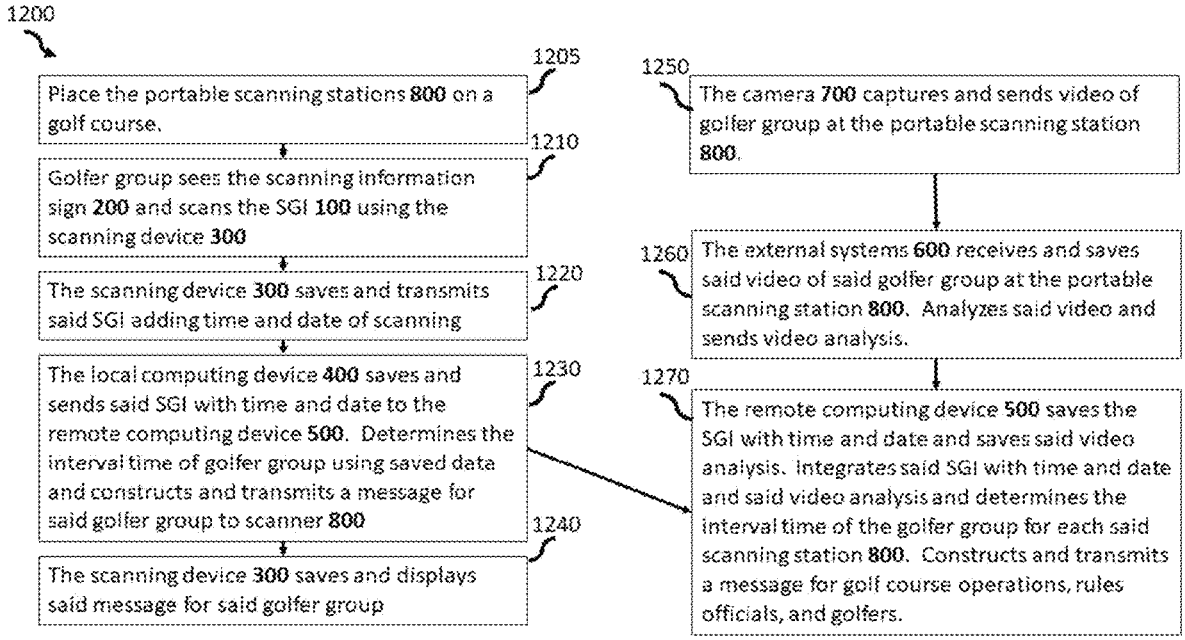
FIG. 11 is an illustrative flowchart depicting operation of the method for managing interval time related to recorded information during a round of golf, in accordance with aspects of the invention.

Referencing FIG. 11, at step 1205, the portable recording station 800 is preferably located in a teeing area of a golf hole. The preceding golf hole is preferably a hole with a design having a minimal impact on position of the golfer group related to the golfer group ahead whereby the interval time can be attributed to the golfers in the golfer group behind the golfer group ahead.

Referencing FIG. 11, at step 1210, a golfer group arrives at the portable recording station 800, a golfer uses the scanning device 300 to record the scannable golfer identifier (SGI) 100. The scannable golfer identifier (SGI) 100 as illustrated in FIG. 3 is an example of an SGI particularly suited for use in the interval time management method 10. The hand-held, scanning device 300 as illustrated in FIG. 5 is an example of the remote unit particularly suited for use in the interval time management method 10 of FIG. 1.

Referring to FIG. 11. At step 1220, an SGI is received. The scanning device 300 records the date, time and SGI data and transmits recorded data to the local computing device 400. At step 1230, The local computing device 400 analyzes said recorded data and computes interval time of the golfer group for the most recently received SGI in the following manner:

General form of group interval time (IT) is:

$T_{n,b}$ is defined as clock time of golfer group n when scanning device 300 was used by to record SGI of golfer group n at portable recording station b.

$T_{(n+1),b}$ is defined as clock time of golfer group n+1 when scanning device 300 was used by to record SGI of golfer group n+1 at portable recording station b.

$IT_{(n+1),b}$ is defined as interval time of golfer group n+1 at portable recording station b.

Where, $IT_{(n+1),b}=T_{(n+1),b}-T_{n,b}$

TABLE 1 is an illustrative example of the interval time of golfer group calculation at portable recording station b:

| SGI | Tn | n | IT (n + 1) |
|---|---|---|---|
| aaaaaa | 11:33:39 | 1 | |
| xkaqku | 11:41:37 | 2 | 7.97 |

Continuing at step 1230, the interval time of the golfer group is evaluated compared to the threshold interval time for the portable recording station 800 to determine a status message. A status message is transmitted to the scanning device 300. At step 1240, the transmitted status message is displayed on the scanning device 300. Messages sent to the scanning device 300 from the local computing device 400 are received by wireless transceiver 360 or wired input/output module 365 and processed by the central processing unit (CPU) 370 and sent to the small display 390. Messages are for the golfer group to be aware of the status of interval time of the golfer group. An exemplary status message has red background with a message, "out of position, please move with purpose to get closer to group in front of your group." Another exemplary status message has green background with a message, "You are in position, continue staying close to the group in front of you."

Referring to FIG. 11. In step 1250, about the same time a golfer of the golfer group uses the scanning device 300, a video camera 700 near the scanning device 300 records video of the area and transmits the data through the local computing device 400 to the external system 600 for video analysis. In step 1260, the external system 600 analyzes the video including information about the golfer group near the portable recording station 800. The external system 600 transmits the video and a video analysis result to a remote computing device 500. At step 1270, the remote computing device 500 integrates the video analysis from an external system 600 and the recorded data from the local computing device 400 to confirm most of the golfer group associated to the SGI were near the scanning device 300 when the scan of the SGI 100 occurred. The remote computing device 500 transfers information to the local computing device 400 after receiving the SGI 100 scan indicating if the golfer group are in the video at the time of the SGI 100 scan. The recorded time of the golfer group will be set to the time of the recording of the SGI 100 or the time when the video analysis result is the golfer group was near the portable recording station 800.

Figure 12:
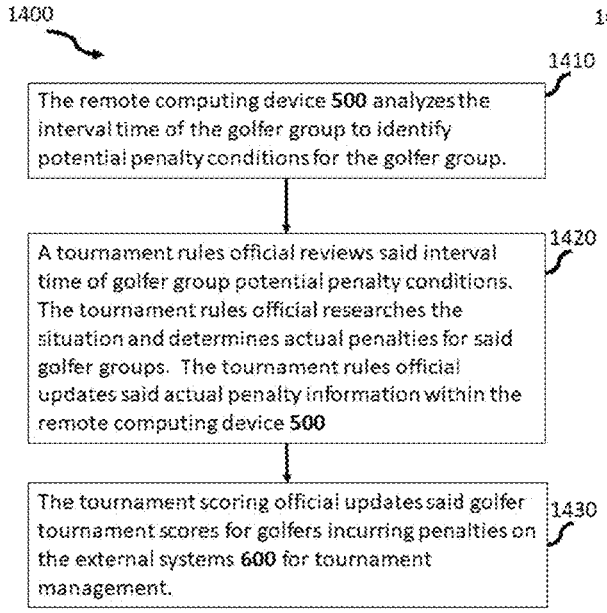
FIG. 12 is an illustrative flowchart depicting operation of the method for managing interval time related to using recorded information to determine tournament penalties for interval time during or after a round of golf, in accordance with aspects of the invention.

Referring to FIG. 12. In step 1410, The video data and interval times of the golfer groups are analyzed and provided to rules officials and staff at the golf course to indicate golfer groups with long interval times of the golfer group. In step 1420, using the interval time values of the golfer groups at the course, the remote computing device 500 can perform analysis of the data and long interval times whereby there are wait times for golfer groups behind the golfer group with the long interval time of the golfer group. In an example embodiment of the invention, the remote computing device 500 determines the status of a penalty of a golfer group for each portable recording station 800 in the following manner:

Inputs $T_{n,x}$ is defined as portable recording station x clock time for golfer group n $IT_{n,x}$ is defined as interval time for golfer group n at portable recording station x ITT is defined as interval time threshold $SPOP_{n,x}$ is defined as the expected cumulative amount of time to complete the golf holes before portable recording station x for golfer group n POPT is defined as pace of play threshold time General Form of Penalty Status Calculation $$T_{n,x}-SPOP_{n,x}\geq POPT$$

$$IT_{n,x}\geq ITT$$

If both conditions are true, golfer group is subject to penalty review.

TABLE 2 is an illustrative example of the golfer group subject to penalty at portable recording stations 800 locations a, b, c, and d:

| SGI | IT a | Penalty Status $_a$ | IT b | Penalty Status $_b$ | IT c | Penalty Status $_c$ | IT c | Penalty Status $_d$ |
|---|---|---|---|---|---|---|---|---|
| sjgdyh | 7.00 | | 7.00 | | 7.00 | | 7.00 | |
| gxywbh | 10.18 | | 8.08 | | 8.52 | | 9.38 | |
| mkqsww | 9.69 | | 11.00 | | 8.68 | | 8.49 | |
| mdfdsj | 9.69 | | 12.83 | Penalty | 12.55 | Penalty | 8.49 | |
| derxak | 9.68 | | 7.38 | | 11.07 | | 13.87 | Penalty |
| entggu | 7.00 | | 7.87 | | 7.00 | | 7.00 | |

Once the remote computing device 500 has performed the analysis and identified the golfer groups with long interval times, mitigating instructions can be determined and proactively sent to rules officials, and staff at the course whereby providing consequences for the golfer group with high interval time for the golfer group. For example, message to send marshals to the golfer group with long interval times to let them know they are out of position and suggest ideas to improve their interval time including skipping holes.

Figure 13:
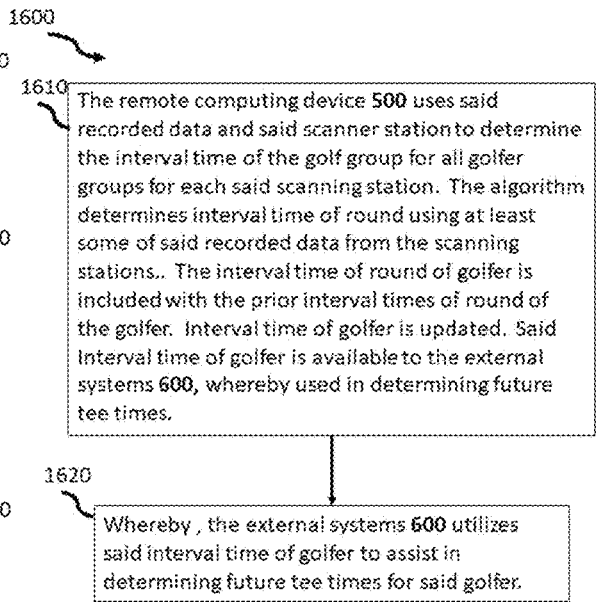
FIG. 13 is an illustrative flowchart depicting operation of the method for managing interval time related to using recorded information to update interval time of golfers, in accordance with aspects of the invention.

Referring to FIG. 13, in step 1610, illustrates a method for using said recorded data transferred from the portable recording stations 800 to the remote computing device 500. In an example embodiment of the invention, the remote computing device 500 determination of interval time for the round of the golfer in the following manner: Group interval time (IT) for round $IT_n$ is defined as interval time of round of golfer group n $IT_{n,x}$ is defined as interval time of golfer group n at portable recording station x Where, $$IT_n = \frac{\sum_{x=1}^{y} IT_{n,y} - \mathrm{MAX}(IT_{n,1}, IT_{n,2}, \ldots IT_{n,y})}{y-1}$$

Assign Round Interval Time to Players $PIT_g$ is defined as interval time of round of golfer g $IT_n$ is defined as interval time of round of golfer group n Example Tee Sheet

. . .

Group 2: Golfer G21, Golfer G22, Golfer G23, Golfer G24

. . .

Group n: Golfer Gn1, Golfer Gn2, Golfer Gn3, Golfer Gn4

$PIT_{G21}=IT_2$

TABLE 3 is an illustrative example of the interval time of the round of the golfer calculation with portable recording stations 800 at locations a, b, c, and d:

| Golfer ID | SGI | IT (n, a) | IT (n, b) | IT (n, c) | IT (n, d) | PITg |
|---|---|---|---|---|---|---|
| 1255762 | xkbqku | 7.75 | 7.97 | 7.98 | 13.35 | 7.90 |
| 9278412 | fzmgck | 7.22 | 9.75 | 8.10 | 8.98 | 8.10 |
| 9738435 | pgxjdq | 13.48 | 10.23 | 10.57 | 10.43 | 10.41 |
| 9021037 | fcmfhy | 12.13 | 10.95 | 8.75 | 12.97 | 10.61 |
| 9163836 | rrjbzv | 8.15 | 8.22 | 9.98 | 8.03 | 8.13 |

Referring to FIG. 13 and continuing in step 1610, each interval time of the round of the golfer is connected to the prior interval time of the rounds of the golfer. The interval time of the golfer is updated with at least some of the interval times of the rounds of the golfer to establish the interval time of the golfer. In an example embodiment of the invention, the remote computing device 500 determination of historical golfer interval time calculation with for golf rounds j, k, l, m, n, o and p in the following manner:

Variables $PIT_{g,x}$ is defined as golfer g round x interval time of round x of golfer g, $GIT_g$ is defined as interval time of golfer g, where interval time of golfer g for rounds 1 to n $$GIT_g = \mathrm{Median}(PIT_{g,1}, \ldots, PIT_{g,n})$$

Whereby golfers can have a few exceptionally high round interval times with minimal impact on their GIT.

TABLE 4 is an illustrative example of the interval time of golfer (GIT) calculation for golf rounds j, k, l, m, n, o and p:

| Golfer ID | PIT j | PIT k | PIT l | PIT m | PIT n | PIT o | PIT p | GIT |
|---|---|---|---|---|---|---|---|---|
| 9718435 | 7.69 | 7.42 | 8.79 | 7.98 | 10.61 | 9.86 | 8.47 | 8.47 |
| 9071037 | 8.58 | 9.00 | 7.75 | 8.34 | 10.24 | 10.61 | 11.01 | 9.00 |
| 9163836 | 9.10 | 12.29 | 10.08 | 8.72 | 8.96 | 8.06 | 8.70 | 8.96 |

Referring to FIG. 13, in step 1620, the external systems 600 utilizes the interval time of the golfer to assist in determining future tee times whereby providing golf course tee time scheduling and golfer access to tee times resulting in reduced wait times, improved course utilization, improved revenue, rewarding golfers for tracking and minimizing interval time and improving the overall golfer experience.

In accordance with an example embodiment of the present invention, remote computing device 500 is operable to communicate with and aggregate data from each of the local computing devices 400 throughout the golf course.

The tracking, data aggregation, calculations, determinations, derivations, etc. are performed by the combination of hardware and software embodied in the interval time management method 10, as described herein. The interval time management method 10 provides the hardware and software installed thereon to efficiently and expeditiously process the various algorithms discussed herein.

A variety of algorithms can be utilized by the Interval time management method 10 in determining various interval times including for a golfer group, a round or a golfer. The above examples of algorithms are not intended to limit the present invention to the golf course illustrative example, but the steps of these algorithms are provided for explanation purposes.

In another embodiment, the portable recording stations 800 can be used to determine the pace standard for each hole. Placing the portable recording stations 800 at the teeing area of consecutive holes allows the recorded data to be used to determine the standard pace time for the hole correlated to interval times of golfers. The historical data can be used to establish hole pace variability. The correlated variability of hole pace to the interval times of golfers is available whereby golf course management increases golf course utilization and revenue with more frequent tee times for golfers with low interval times of the golfer.

As utilized herein, the terms "comprises" and "comprising" are intended to be construed as being inclusive, not exclusive. As utilized herein, the terms "exemplary" "example", and "illustrative", are intended to mean "serving as an example, instance, or illustration" and should not be construed as indicating, or not indicating, a preferred or advantageous configuration relative to other configurations.

Figure 2:
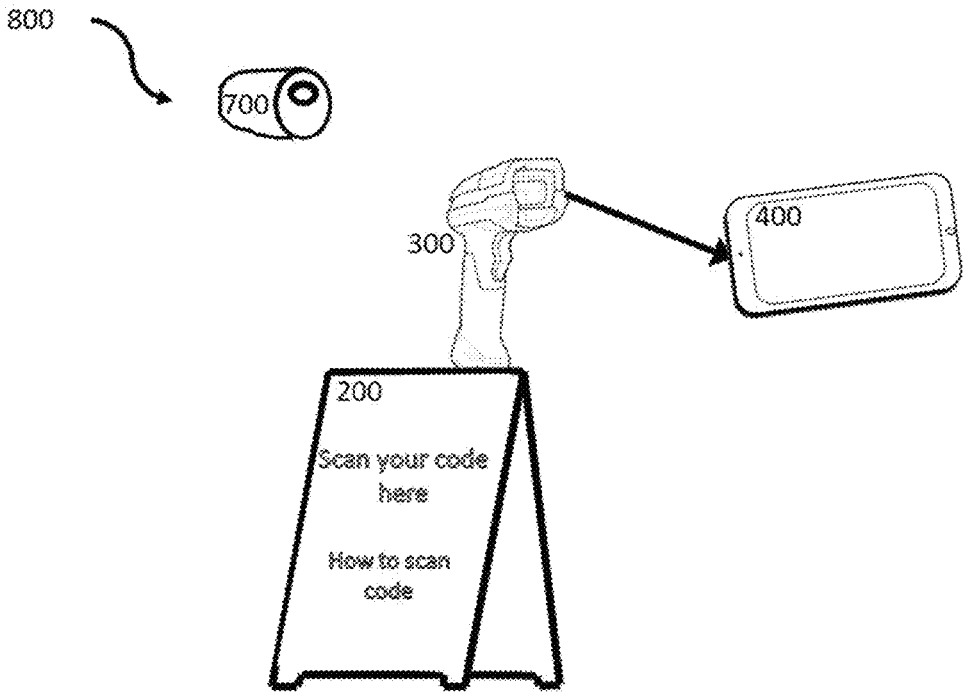
FIG. 2 is illustrative of the portable recording station in accordance with the aspects of the invention.

There are additional embodiments and applications of the interval time management method and system which are not disclosed in this detailed description, but which would fall within the scope of said invention. For example, as seen in FIG. 2, the elements comprising the portable recording station 800, the scanning device 300, the camera 700 and local computing device 400 can be one smart phone. Based on the foregoing, this specification is intended therefore to illustrate and clarify the nature of this invention and not limit its scope.

CONCLUSION

The invention is a low cost, reliable, portable solution to record, respond and reuse interval time to improve the golf experience and increase utilization of the golf course whereby increasing revenue. The invention can be used on any golf course at any time with a few portable recording stations and a scannable code for each golfer group. The invention simplicity, portability and use of off-the-shelf devices whereby the interval time of the golfer becomes the golfer controllable standard of measure throughout golf.

The invention claimed is:

1. A system comprising:

a plurality of scannable golfer identifiers;

a plurality of portable recording stations;

a remote computing device;

wherein a portable recording station of the plurality of portable recording stations comprises a notification sign, a scanning device, a local computing device, and a video camera; and wherein the scanning device is a gun-shaped device with a pistol grip handle and comprises a movable trigger, a light source, detector circuitry, a timekeeping module, a memory module, a battery, a wireless transceiver, and a wired input/output module, the scanning device being configured to read individual scannable golfer identifiers of the plurality of scannable golfer identifiers, save in the memory module and send processed scannable codes and time of scanning to the local computing device using the wireless transceiver or via the wired input/output module.

2. The system of claim 1, wherein a scannable golfer identifier includes a score recording item, a hole-by-hole completion time, and a scannable golfer identifier code.

3. The system of claim 1, wherein the notification sign comprises a self-supporting portable frame, a set of instructions for indicating when to use the individual scannable golfer identifiers and to use the scanning device to scan the individual scannable golfer identifiers.

4. The system of claim 1, wherein the local computing device comprises a housing, a bus, a memory, a display, input/output devices, and a power supply, the local computing device being configured to;

receive, store, and analyze the processed scannable codes and the time of scanning from the scanning device;

receive, store and process video data from the video camera;

receive, store, and process the video data, tee times, and the individual scannable golfer identifiers from the remote computing device; and process information and present golfer interval time and interval status on the display.

5. The system of claim 1, wherein the video camera comprises a camera, a processor, a memory, input/output modules, and a power supply configured to record video data of an area near the scanning device and transmit the video data to the local computing device.

6. The system of claim 1, wherein the remote computing device comprises a cloud computing and storage environment, and database management system configured to collect, aggregate, analyze, and provide metrics using recorded data received from a plurality of information sources.

* * * * *